US005096445A

United States Patent [19]

Lostumo

[11] Patent Number: 5,096,445

[45] Date of Patent: Mar. 17, 1992

[54] ANODE CONNECTOR ASSEMBLY FOR A CATHODE RAY TUBE

[75] Inventor: Arthur J. Lostumo, Franklin Park, Ill.

[73] Assignee: Zenith Electronics Corporation, Glenview, Ill.

[21] Appl. No.: 685,782

[22] Filed: Apr. 15, 1991

[51] Int. Cl.[5] ..... H01R 11/22

[52] U.S. Cl. ..... 439/865; 29/863; 439/278; 439/909

[58] Field of Search ..... 439/278, 269, 592, 825, 439/834, 888, 909, 865-867; 29/857, 876, 863

[56] References Cited

U.S. PATENT DOCUMENTS 3,587,034 6/1971 Canell ..... 439/269

4,155,614 5/1979 Hall ..... 439/269

4,204,741 5/1980 Hall ..... 439/278

4,894,023 1/1990 Hall ..... 439/278

*Primary Examiner*—Neil Abrams

[57] ABSTRACT

An anode connector assembly provides for connecting to a CRT anode cup a high-voltage conductor consisting of a metal wire covered by resilient insulation. The assembly comprises clamping means for clamping, against the resilience of the insulation, the insulation and a length of bare wire folded back over the insulation. The clamping means including means for making electrical and mechanical connection to the anode cup, whereby an electrical potential carried by the conductor is applied to the anode cup through the wire and the clamping means.

8 Claims, 3 Drawing Sheets

ANODE CONNECTOR ASSEMBLY FOR A CATHODE RAY TUBE

BACKGROUND OF THE INVENTION

1. Field of the Invention

This invention relates to color cathode ray picture tubes and is addressed particularly to an improved anode connector assembly for the introduction of a high voltage potential into the envelope of such tubes.

A high voltage potential is required for operation of the CRT electron gun and for energizing the screen of the tube. The potential is in the range of twenty to fifty-five kilovolts, with the magnitude of the voltage dependent upon the size and type of tube. The voltage is routed into the tube envelope through what is commonly termed an "anode cup," which comprises a hollow, tapered cup-shaped member sealed into the side wall of the tube funnel, and which has an annular lip for receiving latching means of the anode connector assemble. The anode cup is in contact with an electrically conductive coating on the inside wall of the funnel. The high potential is conducted through a conductive coating on the internal surface of the funnel to the final, accelerating anode of the electron gun located in the neck of the tube, and to the screen of the tube located adjacent to the faceplate.

Connection of the high-voltage to the anode cup is typically made by means of an anode connector assembly. The assembly comprises a disc-shaped, flexible rubber cap from which extend latching means that connect to the anode cup. An electrical conductor that receives voltage from an associated high-voltage supply is routed into the rubber cap and is electrically and mechanically joined with the latching means.

An anode connector assembly must fulfill certain basic requirements. It must be able to conduct and isolate high voltage. The higher the voltage, the more difficult it is to constrain as it tends to "track," that is, to form a parasitic path to a nearby electrical conductor such as the coating on the outside surface of the funnel which is at ground potential. The outer conductive coating, in conjunction with the inner conductive coating, serves as a capacitor in the high-voltage supply circuit.

The anode connector must provide a shield against x-ray emission. X-rays generated by tube are normally confined to the interior of the tube by the presence of the element lead in the glass of the tube envelope. The anode cup however provides a channel for escape of x-rays, and the anode connector assembly must provide supplementary X-ray shielding.

An anode connector assembly known in the art has latching means has a base from which extend hooks for latching onto an anode cup. A metal flap extends from the base, with a hole in the flap for receiving the bared wire of a high-voltage conductor. A second component comprises a circular plate with an internal aperture for passing the hooks. When the plate is forced into a cavity in the anode cap and against the flap, the flap folds down over the bare wire to make electrical and mechanical connection. The assembly relies upon the resilience of the flexible anode cap to make the proper mechanical and electrical connection with the high-voltage conductor.

2. Other Prior Art

U.S. Pat. Nos. 4,204,741 and 4,894,023 to Hall.

OBJECTS OF THE INVENTION

It is a general object of the invention to provide an improved anode connector assembly.

It is another object of the invention to provide an anode connector assembly that is simple in construction, has fewer parts, is easy to assemble, and once assembled, will not come apart.

It is a further object of the invention to provide an anode connector assembly that does not depend on the resilience of the anode cap for connection to high voltage conductor.

It is a more specific object of the invention to provide an anode connector assembly that provides for positive, permanent connection with a high voltage conductor.

BRIEF DESCRIPTION OF THE DRAWINGS

The features of the present invention which are believed to be novel are set forth with particularity in the appended claims. The invention, together with further objects and advantages thereof, may best be understood by reference to the following description taken in conjunction with the accompanying drawings (not to scale), in the several figures of which like reference numerals identify like elements, and in which:

DESCRIPTION OF THE PREFERRED EMBODIMENT

An anode connector assembly according to the invention provides for connecting a high-voltage conductor to a CRT (cathode ray tube) anode cup. The conductor consists of a metal wire covered with resilient insulation. The assembly essentially comprises clamping means for clamping, against the resilience of the insulation, a length of bare wire folded back over the insulation. The clamping means includes means for making electrical and mechanical connection to the anode cup. A high-voltage electrical charge carried by the conductor is applied to the anode cup through the bare ware and the clamping means.

Figure 1:
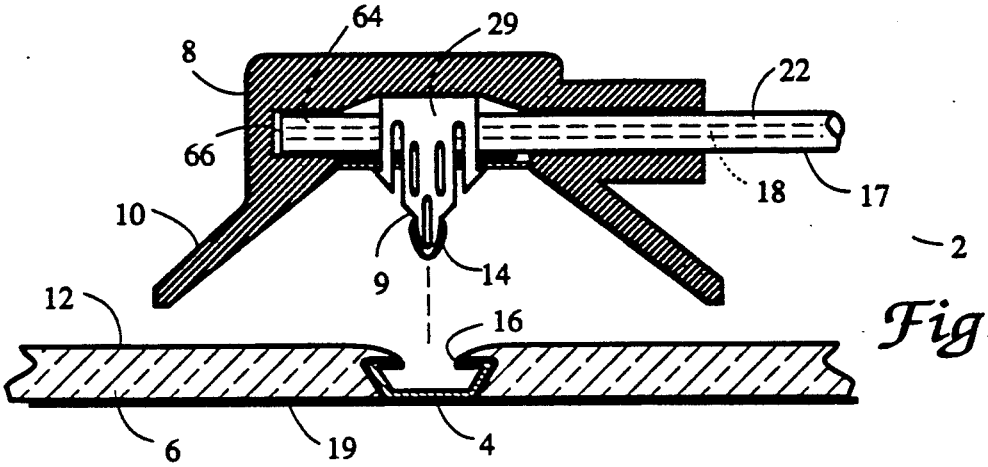
FIG. 1 is cutaway view in elevation of an anode connector assembly according to the invention shown in near-connection with an anode cup located in the funnel wall of a cathode ray tube.

A cross-sectional view of an anode connector assembly according to the invention is shown by FIG. 1. Anode connector assembly 2 is depicted in near connection with a standard anode cup 4 embedded in the glass wall 6 of a cathode ray tube. A flexible anode cap 8 encloses a clamping component having downwardly extending legs 9. When anode cap 8 is pressed toward the glass wall 6 to make electrical and mechanical connection with the anode cup 4, skirt 10 of anode cap 8 flexes outwardly against the outer surface 12 of glass wall 6. Catches 14 that project from legs 9 lock onto annular ring 16 of anode cup 4. A high-voltage conductor 17 routed into anode cap 8 for electrical connection with anode cup 4. Anode cup 4 is in turn in electrical contact with an internal electrical conductive coating 19 on glass wall 6.

Figure 2:
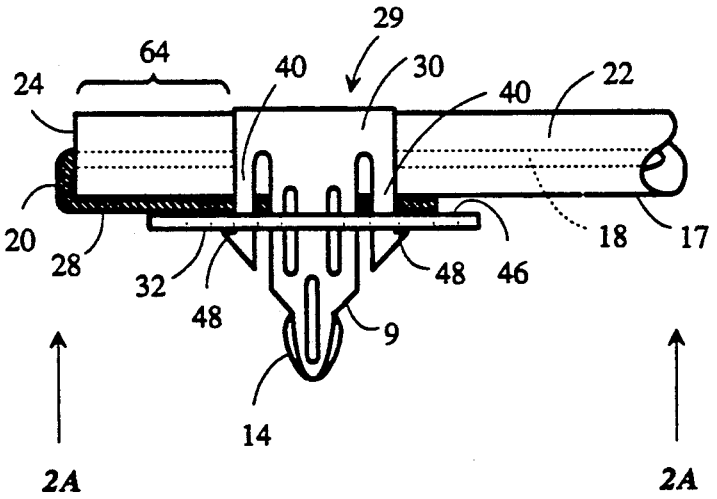
FIG. 2 is a view in elevation showing in greater detail high-voltage conductor clamping means according to the invention located within the anode cap of FIG. 1.

FIG. 2 shows in greater detail the components enclosed in anode cap 8. Conductor 17 consists of a metal wire 18 covered by resilient insulation 22. A length of bare wire 20 projects from the insulation 22 of terminus 24 of high-voltage electrical conductor 17; bare wire 20 is shown as having a section 28 that is folded back over insulation 22.

The insulation 22 of the high-voltage electrical conductor 17 is polyvinyl chloride. The wire 18 internal to the insulation 22 is twisted and is tin-coated to ensure a positive electrical connection with an attached metal part. The diameter of the conductor 17 is about 0.186 inch, and the diameter of the wire 18 is 0.036 inch.

Figure 3:
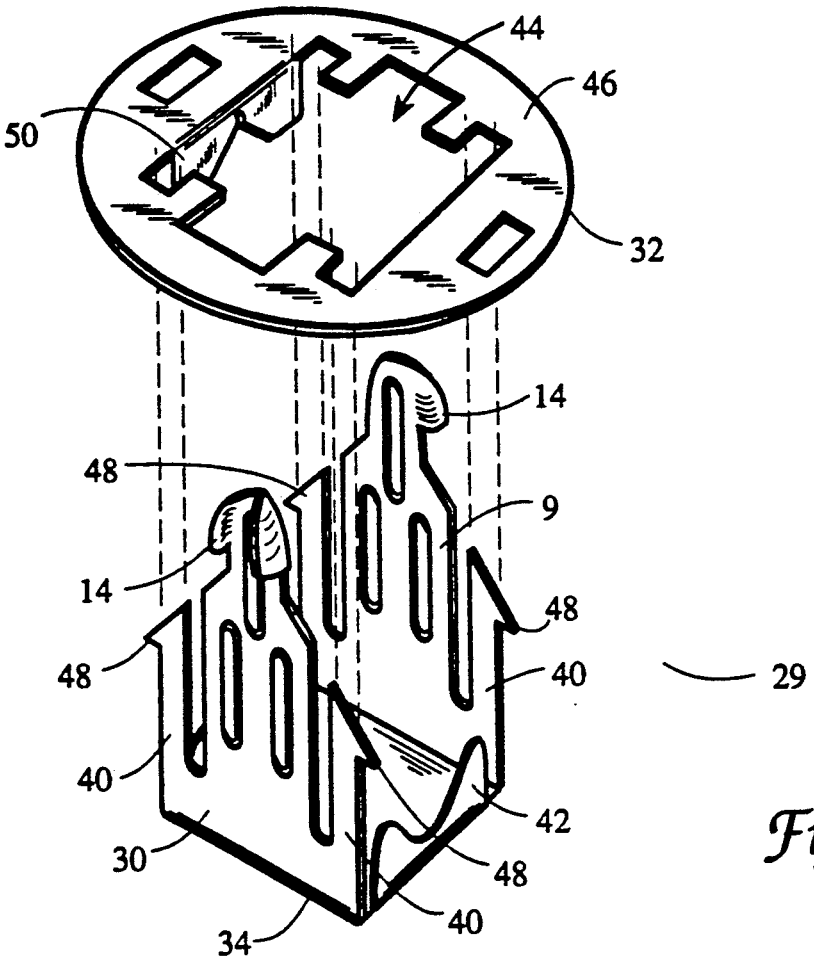
FIG. 3 is an exploded view in perspective showing the relationship of the components of conductor clamping means according to the invention.

High-voltage electrical conductor 17 is shown as enclosed and clamped by clamping means 29. With reference also to FIG. 3, clamping means 29 is shown as comprising a one-piece spring clip 30 and a one-piece flat locking plate 32, both made from sheet metal. Spring clip 30 has a base 34 with two extending legs 9 each of which has a catch 14 for engagement with annular ring 16 of anode cup 4, as described in connection with FIG. 1.

Hook latches 40 are shown as extending from base 34 of spring clip 30 on either side of legs 9. A first cradle 42 provides for receiving conductor 17, as will be described.

Figure 4A:
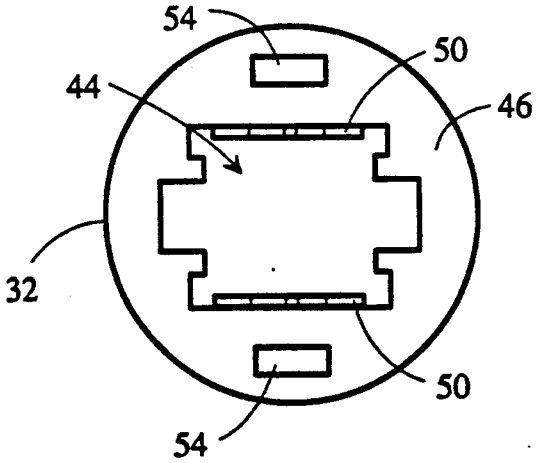
FIG. 4A is a plan view showing further details of a component depicted in FIG. 3.
Figure 4B:
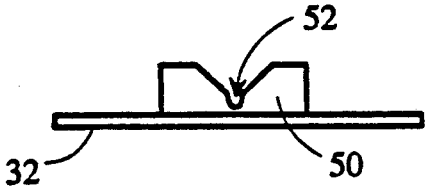
FIG. 4B is a view in elevation of the component.
Figure 5:
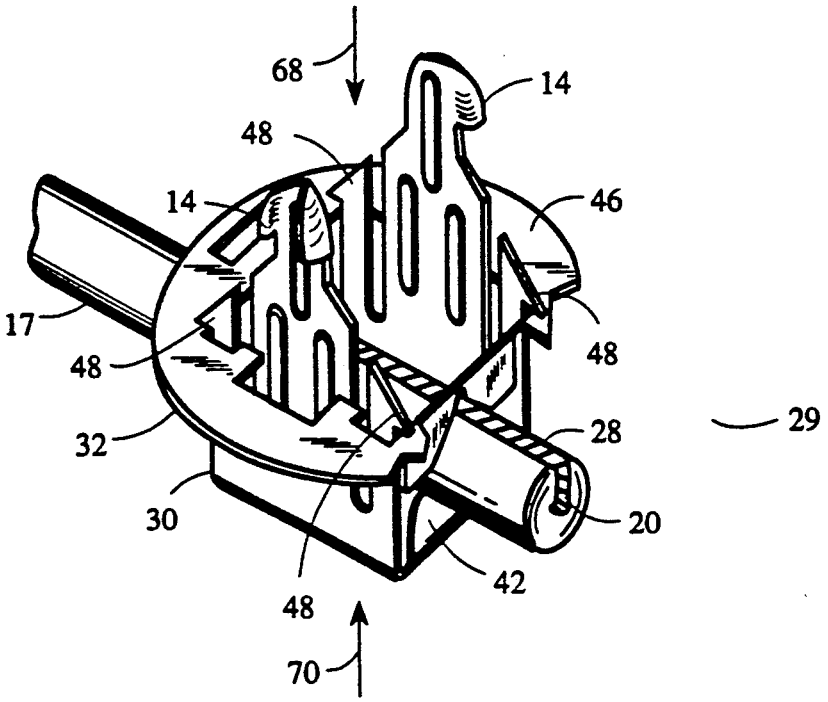
FIG. 5 is an assembled view of the clamping means shown by FIG. 3; the clamping means is partially cut away to show a high-voltage conductor clamped therein.

Locking plate 32 of clamping means 29, shown as exploded from spring clip 30, provides for mating and locking with spring clip 30; additional views of the locking plate 32 are shown by FIGS. 4A and 4B. Locking plate 32 has an aperture 44 for receiving and passing the legs 9 of spring clip 30, and a ledge 46 for receiving the hooks 48 of hook latches 40 that extend from spring clip 30. Locking plate 32 has a second cradle 50 which faces first cradle 42 for enclosing conductor 17 and the folded-back section 28 of bare wire 20. This configuration is shown by FIG. 5, in which locking plate 32 is shown as mated and locked with spring clip 30, with a conductor 17 enclosed therein. The two parts are permanently locked together by the hooks 48 of hook latches 40 which rest and catch firmly on ledge 46 of locking plate 32. As a result, and as depicted in the cutaway section, the insulation 22 and the folded-back section 28 of bare wire 20 are compressed between first cradle 42 and second cradle 50 by the resilience of insulation 22, providing positive electrical and mechanical connection of conductor 17 and clamping means 29.

With reference to FIG. 4B, second cradle 50 is shown as having a notch 52 for receiving the folded back section 28 of bare wire 20. The diameter of the notch is about 0.002 inch less than the diameter of bare wire 20. When the folded-back section 28 of bare wire 20 is forced into notch 52, the wire is effectively crimped into the notch 52, providing for greater mechanical retention and enhanced electrical contact of the wire with the clamping means 29.

Figure 6:
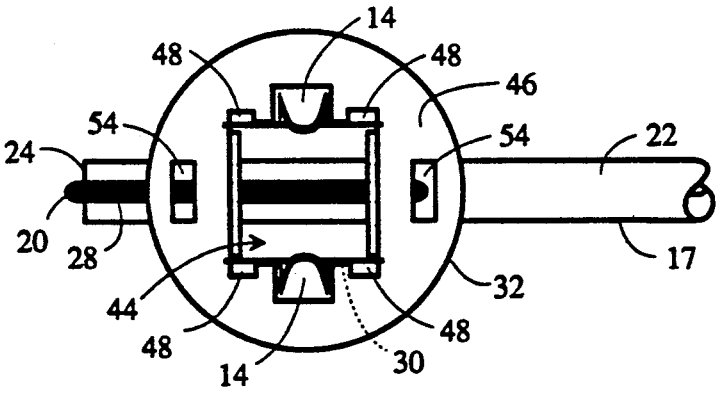
FIG. 6 is a view of an assembled clamping means according to the invention taken along site lines 2A—2A of FIG. 2.

FIG. 6 is a view taken along site lines 2A—2A of FIG. 2, and shows locking plate 32 in mating and locking relationship with the spring clip 30, with conductor 17 and the folded-back section 28 of bare wire 20 compressed between the first and second cradles by the resilience of the insulation 22. The tips of the hooks 48 of the four hook latches 40 are shown as projecting through aperture 44 of locking plate 32, and in engagement with ledge 48. The catches 14 on downwardly extending legs 9 are shown ready for engagement with anode cup 4. During assembly of the conductor clamping means, visual inspection apertures 54 facilitate the insertion of the folded-back section 2 of bare wire 20 into notch 52 in second cradle 50 of locking plate 32.

Figure 7A:
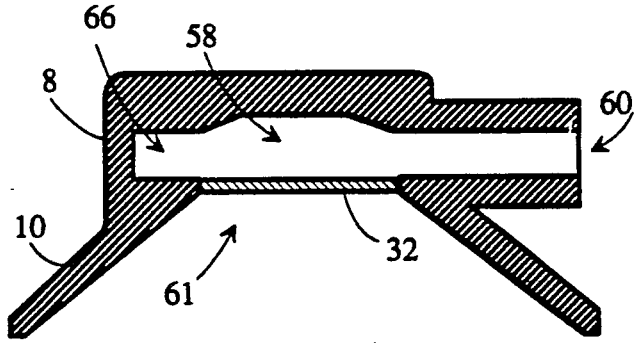
FIG. 7A is a cutaway view in elevation of an anode cap for housing the conductor clamping means according to the invention.
Figure 7B:
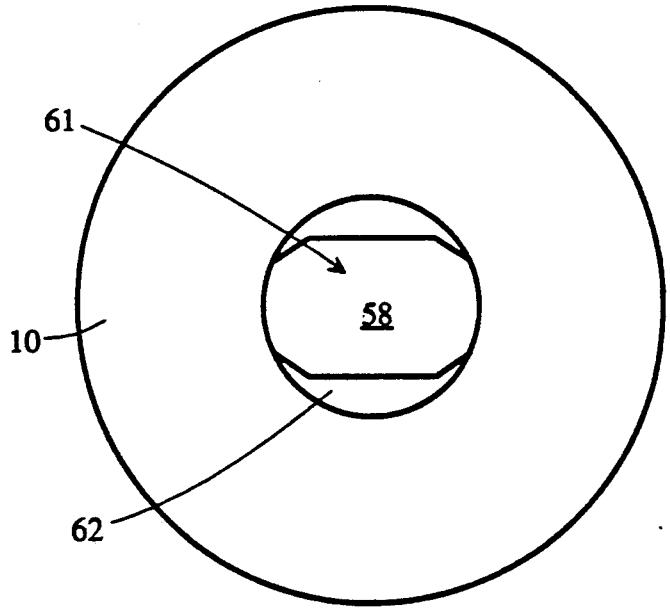
FIG. 7B is a bottom view of the anode cap of FIG. 7A.

The flexible anode cap 8 depicted in FIGS. 7A and 7B encloses the the conductor clamping means 29 in a conforming cavity 58, and orifice 60 receives high-voltage conductor 17. The relationship of anode cap 8, high-voltage conductor 17, and clamping means 29 is indicated in FIG. 1.

Locking plate 32 (the base section without second cradle 50 is shown in FIG. 7A for size comparison) is depicted as enclosed in aperture 61 in anode cap 8. The diameter of locking plate 32 is the same as the diameter of aperture 61 in anode cap 8, and it rests on the shelf 62 indicated in FIG. 7B. The diameter of locking plate 32 and the aperture 61 which encloses it may be three-quarters of an inch, by way of example.

First cradle 42 and second cradle 5 clamp the insulation 22 and the folded-back section 28 of bare wire 20 a predetermined distance from the terminus 24 of conductor 17. The resulting extension of conductor 17 is used as a means to captivate clamping means 29 in anode cap 8. With reference again to FIG. 2, a predetermined extension 64 of conductor 17 is indicated by the bracket; the predetermined distance may be, by way of example, about three-eighths of an inch. Extension 64 of conductor 17 is received in cavity 66 of anode cap 8, as indicated also by FIG. 1. Insertion of extension 64 of conductor 17 into cavity 66 is readily accomplished by flexing leg 10 of anode cap 8 upward by finger pressure, and pushing extension 64 into the cavity.

The combination of spring clip 30 and locking plates 32 that make up the conductor clamping means provides an effective shield against the emission of X-rays which would otherwise pass unhindered through the anode cup.

The material of anode cap is preferably a silicone rubber having a durometer of 55±5 as measured on a Shore type A instrument. A suitable silicone rubber is type KE1995 manufactured by Shin-Etsu Company of Tokyo, Japan. An alternative anode cap material is Elastosil 3001/55, manufactured by Wacker Silicones of Adrian, Michigan.

The metal of spring clip 30 and locking plate 32 preferably comprises half-annealed spring steel according to Specification No. 1095, treated to provide a Rockwell hardness of C40-45. Thickness is about 0.20 inch, and the finish is electro tinplate. The legs 9 of spring clip are biased outwardly to provide for firm, positive connection with the annular ring 16 of anode cup 4.

The spring clip 30 and locking plate 32 of clamping means 29 are mated and locked by pressing them together with the wire enclosed in first cradle 42 and second cradle 50; the direction of pressure is indicated by associated arrows 68 and 70 in FIG. 5. Mating and locking the two parts may be accomplished by means of a pneumatic cylinder and a suitable fixture. Once the parts are locked together, it is almost impossible to separate them.

A method for connecting a high-voltage electrical conductor to an anode connector assembly contained within an anode cap is described in the following. The conductor consists of a wire covered with resilient insulation.

a) Bare a predetermined length of the high-voltage conductor by stripping about one inch of insulation from the conductor. Fold the bare wire back over the insulation.

b) Push the end of the conductor through the conductor-receiving orifice of a flexible anode cap, and on through the aperture far enough to leave a convenient working length extending beyond the cap.

c) Take up a spring clip which has a base with extending legs each having a catch for engagement with the annular flange of CRT anode cup. The spring clip also also has hook latches extending from the base, and a first cradle on the base located between the legs.

d) Take up a flat metal locking plate which has an internal aperture for receiving and passing the legs. The metal locking plate has a second cradle with a notch therein opposing the first cradle.

e) Pas the legs through the aperture in the locking plate. Insert the conductor between the cradles so that the bare section of the wire lies in the notch in the second cradle. Locate the wire in the cradles to form a predetermined extension of the conductor of about three-eighths of an inch.

f) Squeeze the spring clip and the locking plate together against the resilience of the insulation until the the hooks o the hook latches latch onto the ledge of the aperture in the locking plate.

g) Pull upon the conductor and flex the anode cap while pushing the assembled spring clip and locking plate into a conforming cavity in the anode cap. Flex the skirt of the cap while pushing the predetermined extension of the conductor into a second, adjacent cavity in the anode cap.

Assembly is now complete, and the anode connector assembly according to the invention is ready to be installed in a television set or monitor.

Experience has shown that substantial savings can be realized in the manufacture of anode connection assemblies according to the invention. Most important, positive mechanical and electrical interconnection of the components is ensured without reliance upon the resilience of the anode cap.

While particular embodiment of the invention has been shown and described, it will be readily apparent to those skilled in the art that changes and modifications may be made in the inventive means and method without departing from the invention in its broader aspects, and therefore, the aim of the appended claims is to cover all such changes and modifications as fall within the true spirit and scope of the invention.

I claim:

1. An anode connector assembly for connecting to a CRT anode cup a high-voltage conductor consisting of a metal wire covered by resilient insulation, the assembly comprising:

electrically conductive clamping means for clamping together, against the resilience of said insulation, said insulation and a length of bare wire folded back over said insulation, said clamping means comprising a plurality of parts adapted for interlocking engagement about said insulation and said length of bare wire, said clamping means including means for making electrical and mechanical connection to said anode cup, whereby an electrical potential carried by said conductor is applied to said anode cup through said wire and said clamping means.

2. The apparatus defined by claim 1 wherein said clamping means comprises first and second cradling means for cradling from opposed sides said insulation and said length of bare wire, and including latching means for latching said first and second cradling means together against the resilience of said insulation.

3. The apparatus defined by claim 1 wherein said clamping means is housed within a flexible anode cap.

4. An anode connector assembly for mechanical and electrical connection to a standard CRT anode cup having an annular flange, the assembly comprising:

a high-voltage electrical conductor consisting of a metal wire covered by resilient insulation, with a length of bare wire projecting from a terminus of said conductor and folded back over said insulation;

electrically conductive clamping means comprising a one-piece, sheet metal spring clip having a base with extending legs each having a catch for engagement with said annular flange, hook latches extending from said base on either side of said legs, and a first cradle between said legs;

said clamping means further including a sheet metal locking plate for mating and locking with said spring clip, and having an aperture for receiving and passing said legs, a ledge for receiving said hook latches, and a second cradle facing said first cradle for enclosing said electrical conductor and said bare wire;

a flexible anode cap for housing said clamping means;

such that when said spring clip is mated with and locked to said locking plate by said hook latches, said insulation and said bare wire are compressed between said cradles by the resilience of said insulation, providing positive electrical and mechanical connection.

5. The anode connector assembly defined by claim 4 wherein said first cradle and said second cradle clamp said insulation and the folded-back wire a predetermined distance from said terminus to form a predetermined extension of said conductor.

6. The anode connector assembly defined by claim 5 wherein said predetermined extension of said conductor is contained in a conforming cavity in said anode cap for retention of said clamping means in said cap.

7. The anode connector assembly defined by 4 wherein said second cradle has a cleft for receiving and crimping said bare wire.

8. A method of connecting a high-voltage conductor to an anode connector assembly, said conductor consisting of a metal wire within resilient insulation, the method comprising:

providing electrically conductive clamping means including anode cup latching means for mechanical and electrical connection to an anode cup;

folding back a predetermined length of bare wire over said insulation of said conductor;

clamping by said clamping means said insulation and said bare wire against the resilience of said insulation, said clamping means comprising a plurality of parts adapted for interlocking engagement about said insulation and said length of bare wire;

whereby an electrical potential carried by said conductor is applied to said anode cup by said bare wire contacting said conductor clamping means.

* * * * *